US005150158A

United States Patent [19]

Lak et al.

[11] Patent Number: 5,150,158

[45] Date of Patent: Sep. 22, 1992

[54] FLAT SCREEN FOR AN ELECTROPHOTOGRAPHIC PRINTING DEVICE

[75] Inventors: Khosrow Lak, Lawrenceville; E. Neal Tompkins, Atlanta, both of Ga.

[73] Assignee: Colorocs Corporation, Norcross, Ga.

[21] Appl. No.: 605,086

[22] Filed: Oct. 29, 1990

[51] Int. Cl.[5] ..... G03G 21/00

[52] U.S. Cl. ..... 355/239; 355/71

[58] Field of Search ..... 355/239, 240, 230, 228, 355/71, 133, 77

[56] References Cited

U.S. PATENT DOCUMENTS

| | | | |
|---|---|---|---|
| 3,497,296 | 2/1970 | Faw | 355/71 X |
| 3,535,036 | 10/1970 | Starkweather | 355/239 |
| 3,580,671 | 5/1971 | Lavander | 355/239 |
| 3,914,040 | 10/1975 | McVeigh . | |
| 3,936,173 | 2/1976 | Kidd et al. . | |
| 3,961,847 | 6/1976 | Turner et al. . | |
| 3,963,342 | 6/1976 | Stark et al. . | |
| 3,967,894 | 7/1976 | Tsilibes | 355/326 |
| 4,003,649 | 1/1977 | Goren et al. | 355/239 |
| 4,007,981 | 2/1977 | Goren | 355/239 X |
| 4,012,137 | 3/1977 | Goren . | |
| 4,066,351 | 1/1978 | Kidd . | |
| 4,066,353 | 1/1978 | Bobbe . | |
| 4,072,414 | 2/1978 | Hanson | 355/232 X |
| 4,095,889 | 6/1978 | Goren . | |
| 4,179,209 | 12/1979 | Goren . | |
| 4,227,795 | 10/1980 | Bobbe et al. . | |

*Primary Examiner*—Richard L. Moses

*Attorney, Agent, or Firm*—Ross, Howison, Clapp & Korn

[57] ABSTRACT

An electrophotographic printing device having an arcuate photoconductive member (12) includes a flat screen member (32) that is spaced apart from the arcuate photoconductive member (12). A plurality of arcuate opaque lines are disposed on the screen member (32) such that the plurality of arcuate opaque lines are centered along the longitudinal axis thereof. Each of the lines is dimensioned such that it represents the mirror image of the shadow on the photoconductive member that would exist if a straight line were disposed on the screen at the same position.

24 Claims, 4 Drawing Sheets

FLAT SCREEN FOR AN ELECTROPHOTOGRAPHIC PRINTING DEVICE

TECHNICAL FIELD OF THE INVENTION

The present invention relates to electrophotographic printing devices, and more particularly to an optical system having a flat screen with arcuate lines for producing half-tone images of an original document.

BACKGROUND OF THE INVENTION

A typical electrophotographic printing device exposes a charged photoconductive member to a light image of an original document. The irradiated areas of the photoconductive member are discharged to record thereon an electrostatic latent image corresponding to the original image document. A developer mix of carrier granules and toner particles are moved into contact with the latent image recorded on the photoconductive member. Toner particles are attracted electrostatically from the carrier granules to the latent image. In this manner a powdered image is formed on the photoconductive member. Thereafter, the powder image is transferred to a sheet of support material. Subsequent to the transfer, the sheet of support material passes through a fusing device which permanently affixes the powder image thereto.

In photographic printing devices, tone gradations are difficult to form. To minimize this difficulty, screening methods are utilized. Generally, a screening technique produces the effect of tone gradations by variations in dot or line size. In the highlight zones, the dots or lines are small. These dots or lines increase in size through the intermediate shades until the dots or lines merge together in the shallow region. At the highlight end of the tone scale, there may be complete whiteness, while at the shadow end of the tone scale, there may be nearly solid black.

The illumination of an image point is in proportion to the cosine to the fourth power of the angle between the illumination point and the image point. The illumination on a photoconductive surface will fall off quite rapidly as the angle increases. Various techniques have been devised to compensate for this effect. Typically, a sheet of opaque material having a butterfly slit formed therein is employed. The area of the slit is inversely proportionally to the illumination profile. In an exposure system of this type, the original document is positioned on a flat transparent platen. Scan lamps and lenses move across the original document in synchronism with the rotation of the photoconductive drum. Successive incremental areas of the original document are scanned forming a flowing light image which is projected through the slit.

A well known characteristic of such slit exposure systems where the original document is positioned on a flat platen and the light image passes through the slit onto a curved photoconductive member, is image smearing. Image smearing occurs even if the scan and drum velocity are properly synchronized. The loci of exposure points on the drum corresponding to a single point of the original document are defined by the intersection of a plane and a cylinder. A plane is defined by a point and a line to the drum axis and containing any image point on the photoconductive drum. During a slit scan, the image point does not remain stationary on the drum, but rather suffers both lateral and longitudinal translations. Such image motion causes loss of resolution. If a screen member having a plurality of equal spaced opaque lines were placed near the photoconductive surface wherein the lines were aligned parallel to the drum circumference. the lateral image would smear the modulation produced by the screen member. In extreme cases, the modulation could be destroyed near the edges of the drum where smearing is a maximum. For typical drum radii, lens focal lengths and slit widths, this lateral smearing is significant.

Various techniques have been proposed to minimize the smearing as a result of the modulation produced by a screen member for producing half-tone image gradations. Such techniques have utilized arcuate screen members positioned adjacent to the photoconductive drum. One such screen member has a curvature substantially equal to the curvature to the photoconductive member where the center of curvature is substantially in coincidence with the center of curvature of the photoconductive member. Another such proposed system utilizes an arcuate screen member with the plane of curvature of the screen member being substantially normal to the plane of curvature of the photoconductive member. On such screen members, opaque lines are utilized. However, such screen members are difficult to fabricate as well as result in increased costs of such electrophotographic printing devices.

A need has thus arisen for an improved optical system for an electrophotographic printing device such that modulations produced by a screen will not be smeared.

SUMMARY OF THE INVENTION

In accordance with the present invention, in an electrophotographic printing device having an arcuate photoconductive member, a screen member is provided. The screen member is flat and is spaced apart from the arcuate photoconductive member. A plurality of arcuate opaque lines are disposed on the screen member such that the plurality of arcuate opaque lines are centered along the longitudinal axis thereof. The arcuate opaque lines are shaped such that when a light source disposed above the center of the screen member illuminates ones of the opaque lines, the shadow resulting from the opaque lines on the arcuate photoconductive member are substantially straight lines.

In another aspect of the present invention, each of the arcuate lines has a curvilinear shape that is concave-like and extends outward from the center line of the screen on either side thereof and inward toward the center. The degree of the arc of each of the lines increases in an incremental manner as the distance from the center increases.

In yet another aspect of the present invention, each of the arcuate opaque lines is comprised of at least a central segment and two distal segments. The central segment has a first curvilinear shape and the two distal segments have a second curvilinear shape extending outward from the central segment. When the light source is moved from one position above the flat screen member to a second and higher position, the curvilinear shape of the distal sections in combination with the central section results in overall substantially straight lines for the shadow on the arcuate photoconductive member. The central section with the light source disposed at the closest position results in a substantially straight line for the shadow associated therewith.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE INVENTION

Figure 1:
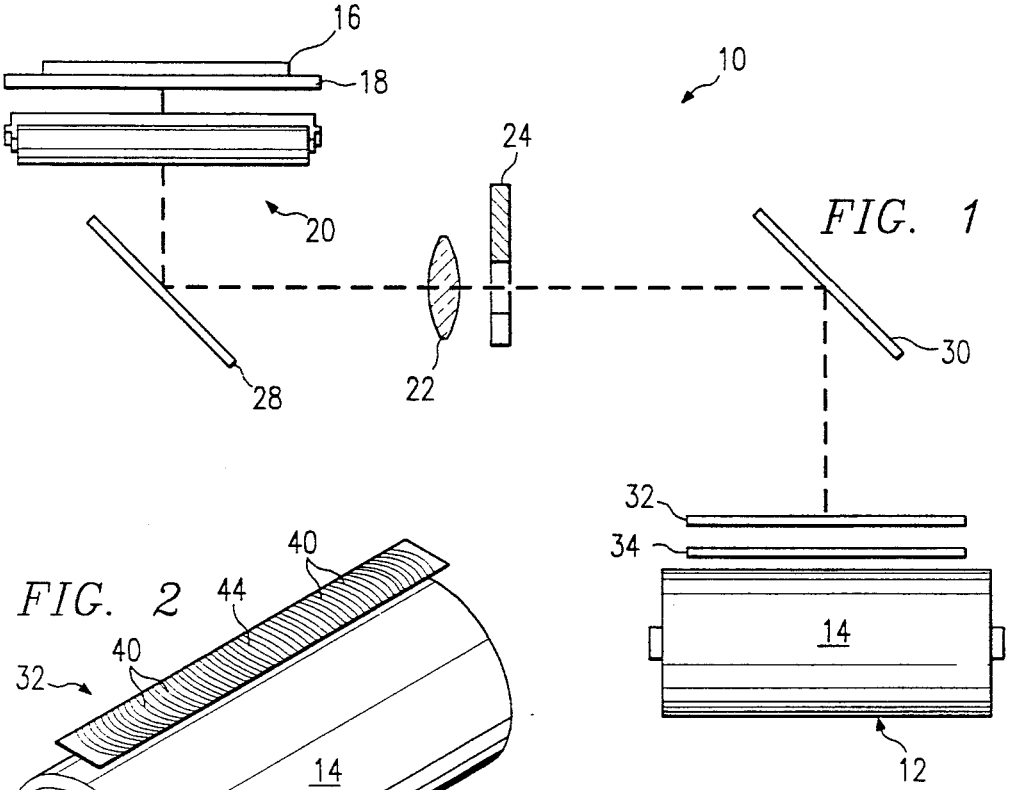
FIG. 1 is an elevational view of an optical system of an electrophotographic printing device utilizing the present invention.
Figure 2:
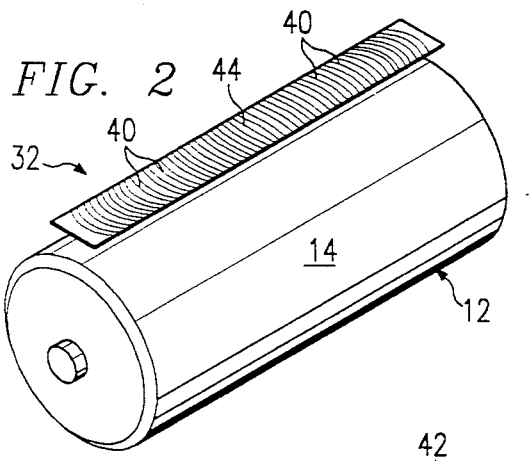
FIG. 2 is a perspective view illustrating the relationship between the present screen and photoconductive member shown in FIG. 1.

Referring now to FIGS. 1 and 2, a portion of an optical system utilized in an electrophotographic printing device is illustrated, and is generally identified by the numeral 10. The electrophotographic printing device generally includes a photoconductive member having a rotatable drum 12 with a photoconductive surface 14 entrained about and secured thereto.

An original document 16 is disposed upon a transparent viewing platen 18. A lamp assembly 20 is positioned beneath transparent viewing platen 18 and, in conjunction with a lens system 22 and filter mechanism 24 moves in a timed relationship with drum 12 to scan successive incremental areas of original document 16. In this manner, a flowing light image of original document 16 is reflected by a mirror 28 through lens 22 at filter 24 to a mirror 30. The light image from mirror 30 is transmitted to irradiate the charged area of photoconductive surface 14.

As illustrated in FIG. 1, a screen 32 in accordance with the present invention, is interposed into the optical light path in order to modulate the light image which irradiates the charged area of photoconductive surface 14.

Also disposed within the optical light path is a scan slit 34 comprising a flat sheet of opaque material such as sheet metal having a butterfly slit therein. The area of the slit varies inversely at the cosine to the fourth power of the solid angle between the illumination point and image point. Scan slit 34 compensates for the nonlinearities in the illumination profile. However, since scan slit 34 is flat, whereas drum 12 is curved, this spacial relationship introduces density variations and color balance shifts in the copy. To correct these variations, screen 32 as more clearly illustrated in FIG. 2, includes a plurality of arcuate opaque lines 40.

Figure 3:
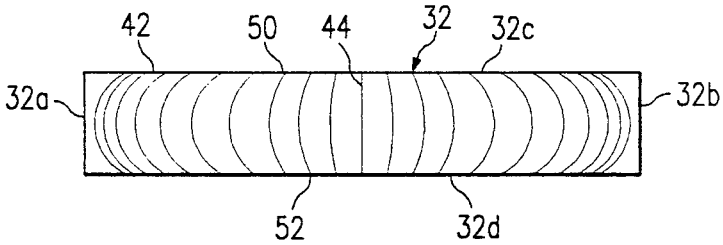
FIG. 3 is a top plan view of the present screen.

Referring simultaneously to FIGS. 2 and 3, screen 32 having ends 32*a* and 32*b* and sides 32*c* and 32*d*, is flat. Screen 32 includes a longitudinal axis 42 extending from end 32*a* to end 32*b*. Arcuate opaque lines 40 extend between sides 32*c* and 32*d* of screen 32 and are centered along longitudinal axis 42. Arcuate opaque lines 40 are disposed on screen 32 such that arcuate opaque lines 40 are concavely positioned to ends 32*a* and 32*b*.

Screen 32 can be fabricated from a substantially transparent sheet made from a suitable plastic, such as Mylar. Arcuate opaque lines 40 may be printed onto sheet 32 by a suitable chemical etching or photographic technique. The center of the arc of each arcuate opaque line 40 is centered on the longitudinal axis 42 of screen 32. The space in between opaque arcuate lines 40 determines the quality of the resulting copy. Arcuate opaque lines 40 will be generally equally spaced along longitudinal axis 42 and centered around a straight opaque line 44. A finer screen size generally results in a more natural or higher quality copy.

The arc of the opaque lines 40 then increases from a straight opaque line at opaque line 44 to a highly arced line at diametrically opposite sides 32*a* and 32*b* in an incrementally increasing manner. Each of the opaque lines 40 is the mirror image of the shadow that would have been cast upon the drum 12 if the opaque lines 40 had been straight lines, as in prior art systems. By replicating the mirror image of the shadow on the drum for a given straight line with the opaque lines 40, the shadow of the opaque lines 40 on drum 12 will therefore be a straight line.

As illustrated in FIG. 3, arcuate opaque lines 40 may include a plurality of spaced opaque dots 50 or lines 52. Lines 52 are perpendicularly disposed to longitudinal axis 42. The number of dots 50 or lines 52 utilized to form arcuate opaque lines 40 determines the coarseness of screen 32.

Figure 4:
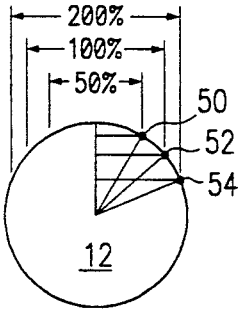
FIG. 4 illustrates an end view of the drum, illustrating the portions of the drum that are covered at three different magnifications, a fifty percent magnification, a one hundred percent magnification and a two hundred percent magnification.

Referring now to FIG. 4, there is illustrated an end view of the drum 12, illustrating the portions of the drum that are covered at three different magnifications, a fifty percent magnification, a one hundred percent magnification and a two hundred percent magnification. In the preferred embodiment, drum 12 has a diameter of 140 mm and the screen 32 has approximately 120 lines/inch. The screen 32 is positioned 1 mm away from the surface of the drum 12 along the central axis thereof. At fifty percent magnification, the lens 22 is disposed 565 mm away from the surface of the drum 12, at one hundred percent magnification, the light source is disposed 562 mm away from the surface of the drum 12, and at two. hundred percent magnification, the light source is disposed 759 mm away from the surface of the drum 12. The fifty percent slit width is 74.25 mm×3.25 mm. The slit width for the one hundred percent magnification is 148.5 mm×6.5 mm. The slit width for the two hundred percent magnification is 148.5 mm×13 mm.

With further reference to FIG. 4, the distance from the edge of the slit width to the surface of the drum can be calculated by determining the distance from the tangential to the drum 12 that extends down vertically to a point corresponding to the slit width. For example, the fifty percent slit width is indicated by a point 50 on the drum which is 3.25 mm from the center of the drum along the tangential and 70 mm from the center of the drum. This results in a distance of 0.75 mm from the tangential. The same calculation can be made with respect to a point 52 on the surface of the drum 12 representing the one hundred percent magnification. This point 52 is 6.5 mm from the center of the drum 12 along the tangential and disposed downward from the tangential 0.5 mm. A point 54 corresponds to the two hundred percent magnification which is 13 mm from the center of the drum 12 along the tangential and 1.218 mm from the tangential to the surface of the drum 12. Therefore, the distance from the edge of the slit width to the surface of the drum for the fifty percent magnification slit width of 3.25 mm would be 1.075 mm, the distance from the edge of the slit width to the surface of the drum 12 for the one hundred percent slit width of 6.5 mm would be 1.35 mm and the distance from the edge of the slit width to the surface of the drum 12 for the two hundred percent slit width of 13 mm would be 2.218 mm. This is due to the fact that the screen is disposed 1 mm from the surface of the drum.

Figure 5:
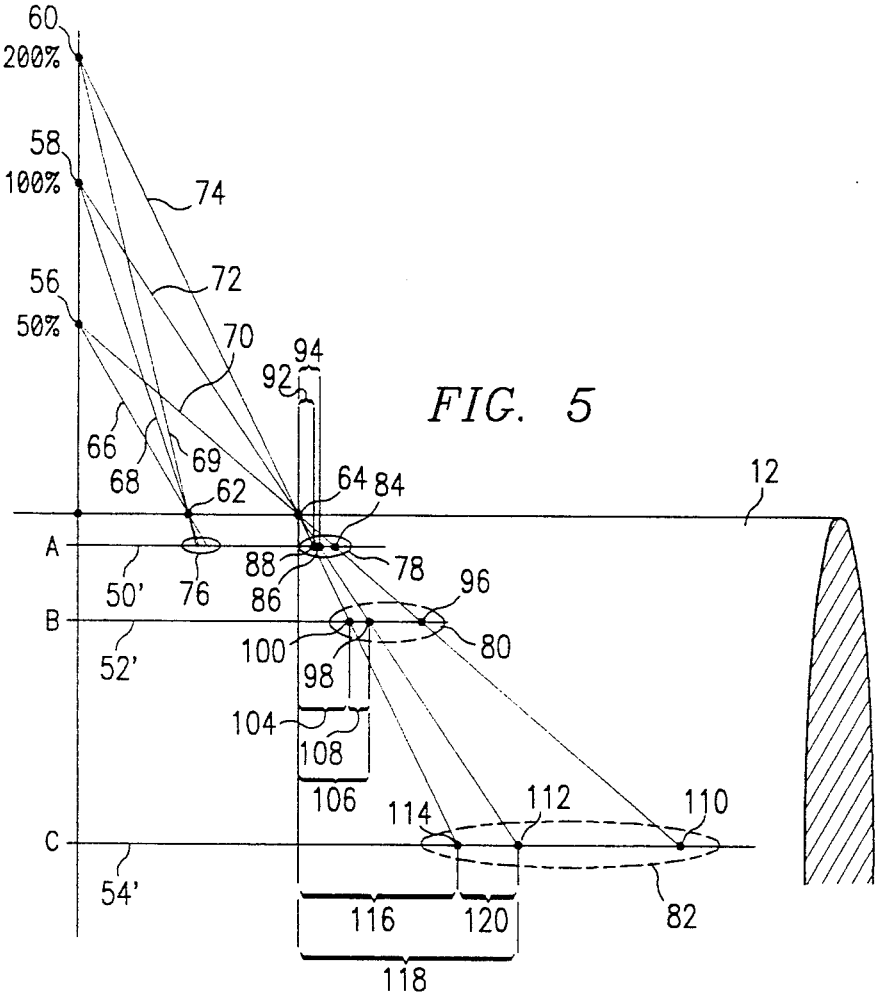
FIG. 5 illustrates a side view of the drum, illustrating a light source at a point for the fifty percent, one hundred percent, and two hundred percent magnification.

Referring now to FIG. 5, there is illustrated a side view of the drum 12, illustrating the lens 22 at a position 56 for the fifty percent magnification, at a position 58 for the one hundred percent magnification and at a position 60 for the two hundred percent magnification. There are two slit widths along the longitudinal axis of drum 12 that are provided, a 74.25 mm slit width and a 148.5 mm slit width. The 74.25 mm slit width is represented by a point 62 on the surface of the drum 12 and the 148.5 mm slit width is represented by point 64 on the surface of the drum 12. The points 62 and 64 represent the point at which the light would impinge on the surface of the drum 12 if it were to pass through the last one of the lines on the screen 32 for the two different slit widths. In the case of the fifty percent magnification, the point 62 would be utilized, and in the case of the one hundred percent and two hundred percent magnifications, the point 64 would be utilized.

The description of FIG. 5 illustrates the shadow that would result if a straight line were utilized at the points 62 and 64. As will be described hereinbelow, it is only necessary to determine what the shadow for a straight line in the screen would look like on the surface of the drum 12 and then provide a mirror image of this on the screen itself. The lens at position 56 at the fifty percent magnification level, as described above, is disposed away from the surface of the drum 12 a distance of 565 mm, the lens at position 58 corresponding to the one hundred percent magnification level is disposed away from the surface of the drum 12 a distance of 562 mm and the lens at position 60 corresponding to the two hundred percent magnification is disposed away from the surface of the drum 12 a distance of 759 mm. The lens at positions 56, 58 and 60 emanate light rays 66, 68 and 69, respectively, to the point 62. In a similar manner, the lens at positions 56, 58 and 60 emanate light rays 70, 72 and 74, respectively, to the point 64. The points 62 and 64 represent the point along the center line of the drum 12. However, as described above, when the light extends outward along the flat screen 32 in a straight line perpendicular to the axis of the drum 12, it will impinge the surface of the drum 12 at a distance further out from the central portion of the drum 12.

The points 50, 52 and 54 in FIG. 4 are represented by lines 50', 52' and 54' along the longitudinal axis of drum 12. The lines 50', 52' and 54' represent the shadow of the edge of the slit width. In the 74.25 mm×3.25 mm slit width, the light rays 66, 68 and 69 would impinge along the line 50' in an area 76. In a similar manner, the light rays 70, 72 and 74 impinge upon the line 50' in an area 78, on the line 52' in an area 80 and on the line 54' in an area 82.

With reference to the light rays 70, 72 and 74, they fall on three points, 84, 86 and 88, respectively, on the line 50'. The horizontal distance of each of the points 84–88 can be determined from the trignometric relationship of the light rays, it being known that the angle that the light ray 74 makes with the horizontal is 79°. The distance of the point 88 from the point 64 is represented by a bracket 92.

Light rays 70, 72 and 74 impinge the line 52' at points 96, 98 and 100, respectively. The point 100 associated with the light ray 74 from the lens at position 60 for the two hundred percent magnification is disposed on the line 52' approximately 0.068 mm from the point 64, as represented by a bracket 104. In a similar manner, the point 98 is disposed approximately 0.09118 mm from the point 64, as represented by the bracket 106. The difference between the two points 190 and 100 is 0.023, as represented by a bracket 108.

The light rays 70–74 impinge at points 110, 112 and 114, respectively, on line 54'. The point 114 corresponding to the light rays 74 from the lens at position 60 at the two hundred percent magnification is disposed approximately 0.238 mm from the point 64, as represented by a bracket 116. In a similar manner, the point 112 associated with the light ray 72 and point source 58 at the one hundred percent magnification level is disposed approximately 0.317 mm from the point 64, as represented by a bracket 118. This represents a difference of approximately 0.079 mm between points 112 and 114, as represented by a bracket 120.

With reference to the light ray 74 from the lens at position 60 for the two hundred percent magnification level, it can be seen that a straight bar will result in a shadow at point 64, point 100 and point 114 on the surface of the drum 12. When the lens is moved to the position 58 for the one hundred percent magnification level, the light ray 72 will result and a shadow will be disposed between point 64, point 98 and point 114.

Figure 6:
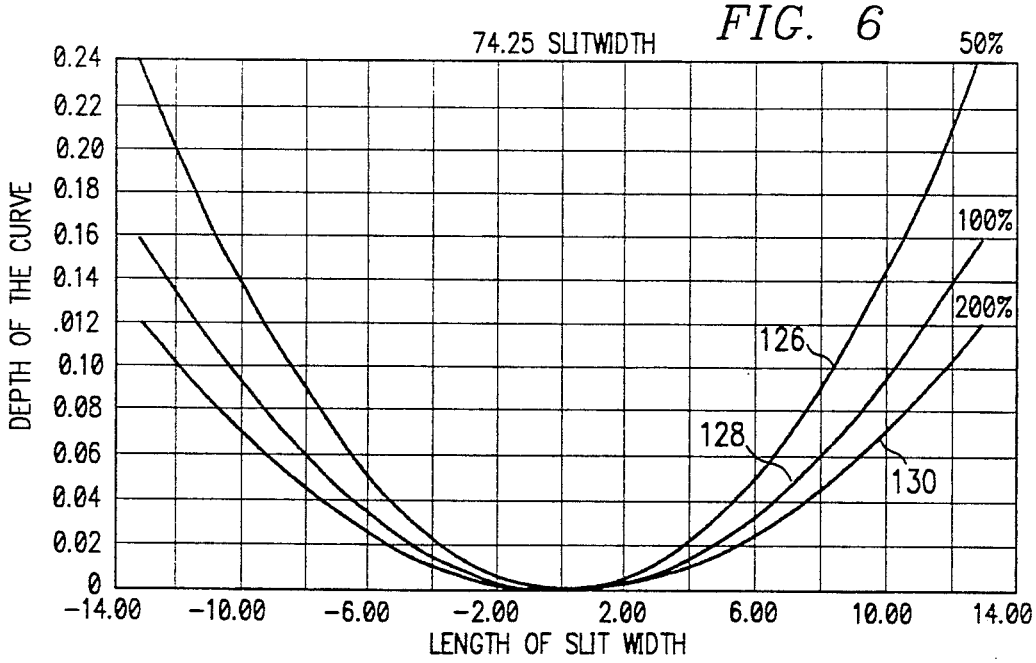
FIG. 6 illustrates a plot of the shadows.

Referring now to FIG. 6, there is illustrated a plot of the shadow as it would appear with the 74.25 mm slit width for the length of the slit width varying from zero to thirteen millimeters. This is for the shadow as it would appear at the point 62 for a distance of 74.25 mm from the center of the drum 12. The shadow resulting from the lens at position 56 is represented by a curve 126, the shadow resulting from the lens at the position 58 for the one hundred percent magnification is represented by a curve 128 and the shadow represented by the lens at position 60 at the two hundred percent magnification level is represented by a curve 130.

Figure 7:
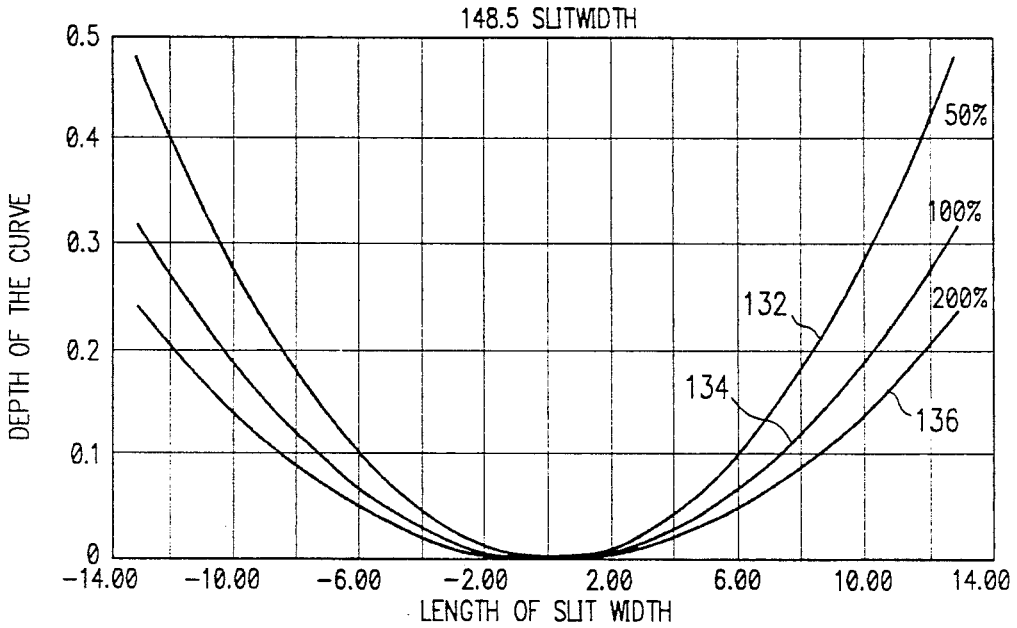
FIG. 7 illustrates a plot of the depth of the curves versus the length of the slit widths.

Referring now to FIG. 7, there is illustrated a similar plot of the depth of the curve versus the length of the slit width for the 148.50 mm slit width with the length of the slit width extending from zero to thirteen millimeters on either side of the center line of the drum 12. The curved shadow for the straight line at the fifty percent magnification level is represented by a curve 132. The shadow of the straight line for the one hundred percent magnification level is represented by a curve 134. The shadow of the straight line for the two hundred percent magnification level is represented by a curve 136.

In the preferred embodiment, adjacent lines are separated by approximately 0.211 mm. The curves of FIGS.

6 and 7 illustrate what the shadow would be for all three magnification levels at the last line of the screen at the most distal end thereof. To compensate for this, a line identical to the shadows illustrated in FIGS. 6 and 7 is incorporated into the screen 32 that are the mirror image of the shadow, i.e. the arc is formed in the opposite direction. If a screen were manufactured for each of the magnifications, this would provide perfect compensation for each magnification. However, it can be seen from FIGS. 6 and 7 that the perfect line for the fifty percent magnification level would present considerable errors at the two hundred percent magnification level, especially at the most distal ends of the screen. As the lines approach the center of the screen 32, the arc of each adjacent line decreases in an incremental manner until it is a straight line. The manner for calculating what the arc of each should be and is identical to that as described above with respect to FIGS. 6 and 7.

Figure 8:
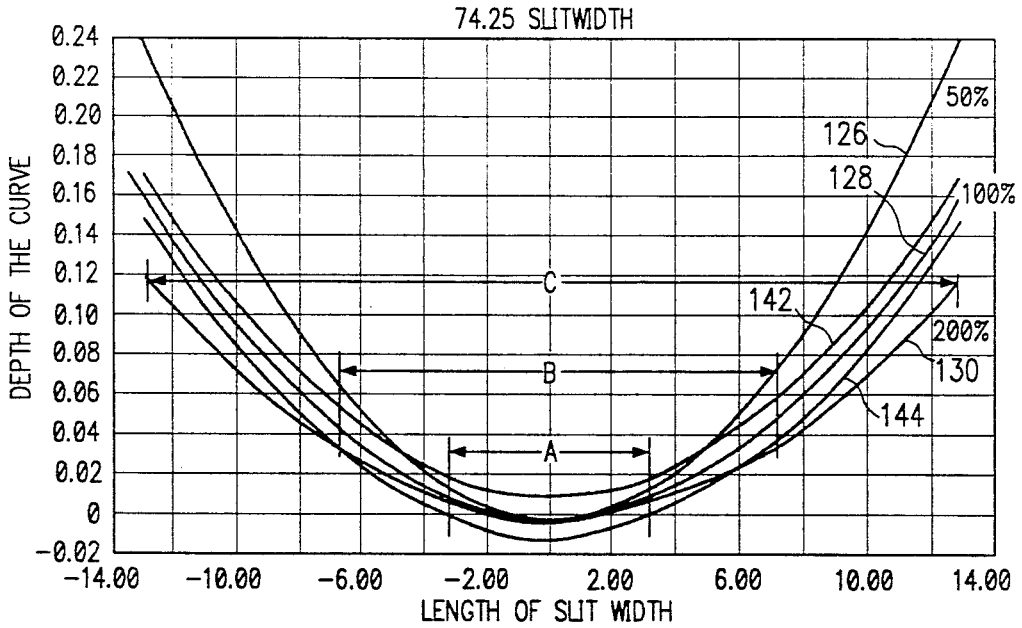
FIG. 8 illustrates an identical plot to that of FIG. 6.

Referring now to FIG. 8, there is illustrated an identical plot to that of FIG. 6 for the 74.25 mm slit width with the curves 126–130 illustrated. However, the curve 128 for the one hundred percent magnification level is expanded to provide a ten percent error margin with a boundary curve 142 and a boundary curve 144 provided on either side of the curve 128, illustrating the ±5% error margins. It can be seen that the dimension A represents the ±3.25 slit width length representative of the fifty percent magnification level. It can be seen that the portion of curve 126 within the boundaries of dimension A fall within the boundary of curves 142 and 144. For the one hundred percent magnification level, the length of the slit width would fall within the Dimension B for the ±6.5 mm slit width length. It can be seen that a portion of the curve 126 falls outside of the boundary curves 142 and 144 when they approach the boundaries of the Dimension B. Therefore, if the curve 126 were utilized as the last line at the 74.25 mm distance from the center of the drum 12, this would result in an error. The Dimension C is illustrated for the ±13.0 mm slit width length at the one hundred percent magnification level. It can be seen that between the Dimension B boundary and the Dimension C boundary that the curve 130 would fall Well outside the boundaries 142 and 144, such that if either the curve 126 or the curve 128 were utilized for the last line at the 74.25 mm distance, this would result in significant error. However, it can be seen that at the B Dimension boundary, the curve 130 falls within the ±5% error of the boundary curves 142 and 144. Therefore, if the curve 128 were utilized, the error at the fifty percent magnification level within Dimension A would be within the ±5% and the error of the two hundred percent magnification level within the Dimension B and the Dimension A would be within the ±5% error. However, outside the Dimension B, operation at the two hundred percent magnification level would result in error.

Figure 9:
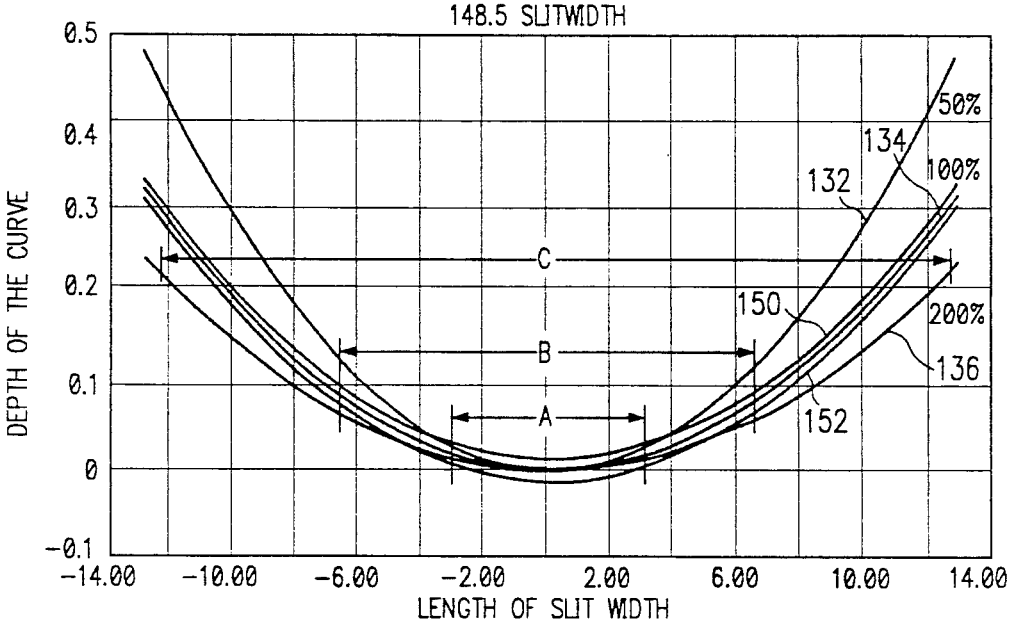
FIG. 9 illustrates a similar curve to that of FIG. 8 plus including error factor curves of ±5% of depth for 100% magnification ratio.

Referring now to FIG. 9, there is illustrated a similar curve to that of FIG. 8 for the 148.50 mm slit width illustrating the curves 132, 134 and 136 with two boundary curves 150 and 152 representing the ±5% error curve for the curve 134 at the one hundred percent magnification level. The Dimensions A, B and C are illustrated, and are similar to those illustrated in FIG. 8.

Figure 10:
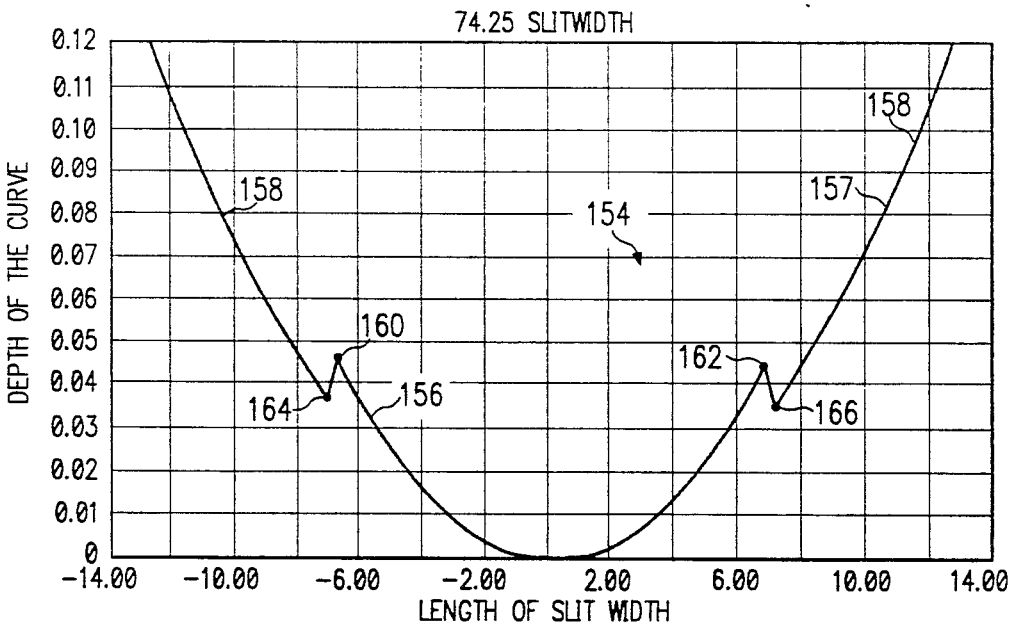
FIG. 10 illustrates a curve that provides a single composite curve solution for the slit width corresponding to the curves of FIG. 6.

Referring now to FIG. 10, there is illustrated a curve 154 that provides a composite mirror image line for the 74.25 mm slit width corresponding to the curves of FIG. 6 and the curves of FIG. 8. The curve 154 is comprised of two portions, a central portion 156 and a distal portion 158. The central portion 156 has a first arc that extends from the length of the first slit width of ±6.5 mm at points 160 and 162 on either side of the center. This provides the best fit for all curves 126, 128 and 130 within the boundaries of the points 160 and 162 between the ±6.25 mm length of the slit width. At the points 160 and 162, the curve is interrupted and moved to points 164 and 166, respectively. This is the beginning point for the distal ends 158 of the curve 154. This portion of the curve is mapped to the curve 130. Therefore, the only discontinuity is the break between the points 160 and 164 and the points 162 and 166. The central portion of the curve 156 provides the best approximation with the least error for the operation at the fifty percent and one hundred percent magnification levels, and the distal portions 158 to provide the best approximation at the two hundred percent magnification level. By utilizing a segmented curve, as illustrated in FIG. 10, the mirror image lines can be fabricated such that they will provide the best fit for all modes of operation. In this manner, the shadow that exists on the surface of the drum 12 will be a straight line and will not have an arc to it. Therefore, the distance of the points from the point 64 in FIG. 5 that would result at lines 50', 52' and 54' would be directly beneath the point 64 and would have no offset relative to the longitudinal axis of the drum 12.

Figure 11:
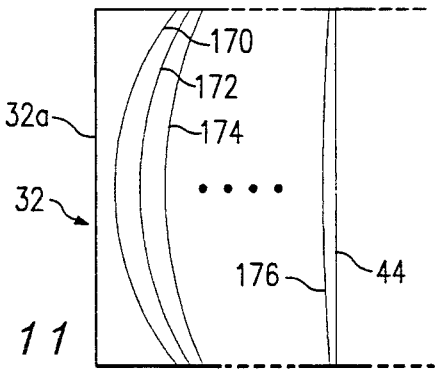
FIG. 11 illustrates a diagram of the screen at one end.

Referring now to FIG. 11, there is illustrated a diagram of the screen 32, illustrating one end 32*a* at the end of the screen 32 with lines 170, 172 and 174, line 170 having the greatest arc and line 174 having an incrementally smaller arc. This continues on down to a line 176 proximate to the center of the screen 32 at the line 44, with the line 176 having a very small arc. Each of the lines 170–176 are comprised of three segments, a center portion and two distal portions, illustrated in FIG. 10.

It therefore can be seen that the present invention provides for a flat screen which is disposed in the optical path of an electrophotographic printing device for the modulation of an electrostatic latent image for recordation on a photoconductive surface. By utilizing a line pattern in the screen that constitutes the mirror image of the shadow that would exist if a straight line were utilized, the image smearing is significantly reduced.

Whereas the present invention has been described with respect to specific embodiments thereof, it will be understood that various changes and modifications will be suggested to one skilled in the art and it is intended to encompass such changes and modifications as fall within the scope of the appended claims.

What is claimed is:

1. A reproduction apparatus having an arcuate photoconductive member, including:

a flat screen member for modulating an exposure source and spaced apart from the arcuate photoconductive member and fixed relative to the movement thereof, said flat screen member having ends and a longitudinal axis perpendicularly disposed to said ends;

a plurality of opaque lines disposed on said flat screen member, said plurality of arcuate opaque lines being centered along the longitudinal axis thereof; and at least one of said opaque lines being arcuate in shape.

2. The reproduction apparatus of claim 1 wherein all of said lines are arcuate in shape and disposed concavely with respect to the ends of said flat screen member along the longitudinal axis thereof.

3. The reproduction apparatus of claim 1 wherein each of said plurality of opaque lines includes a plurality of spaced apart opaque dots.

4. The reproduction apparatus of claim 1 wherein the arcuate shape of said at least one of said opaque lines is shaped such that the shadow of said at least one of said opaque lines on the arcuate photoconductive member is a substantially straight line.

5. The reproduction apparatus of claim 4 wherein all of said opaque lines are arcuate with the arc of all of said opaque lines incrementally decreasing from the distal ends of said flat screen member to the center thereof such that ones of said lines proximate to the center of said flat screen member are substantially straight.

6. The reproduction apparatus of claim 5 wherein each of said arcuate lines is concave in shape and centered along the longitudinal axis of said flat screen member and each of said opaque lines has at least two arcuate shapes, a centrally disposed arcuate shape and a second arcuate shape disposed on the distal ends of said opaque line.

7. The reproduction apparatus of claim 6 wherein each of said opaque lines comprises a separate segment associated with each of said arcuate shapes.

8. A reproduction apparatus having an arcuate photoconductive member, including:

a flat screen member for modulating an exposure source and spaced apart and parallel to a plane that is tangentially disposed on the surface of the arcuate photoconductive member, said flat screen member fixed relative to the arcuate photoconductive member, said flat screen member having ends and a longitudinal axis perpendicularly disposed to said ends;

a plurality of arcuate opaque lines disposed on said flat screen member, each of said lines disposed a predetermined distance apart and centered along the longitudinal axis thereof and extending from one side of said flat screen member to the other side thereof; and each of said opaque lines having an arcuate shape that curves outward from the longitudinal axis of said flat screen member and toward the center of said flat screen member between the two ends thereof.

9. The reproduction apparatus of claim 8 wherein each of said arcuate opaque lines is shaped such that when a light source is disposed at a point above said flat screen member and perpendicularly disposed over the center point thereof between the two ends of said flat screen member, the shadow of each of said opaque lines on the arcuate photoconductor member will be a substantially straight line.

10. The reproduction apparatus of claim 9 wherein each of said arcuate opaque lines has an arcuate shape that is comprised of at least three segments, a center segment and two distal segments, the center segment having a first curvilinear shape and the two distal segments having a second curvilinear shape.

11. A screen for a reproduction apparatus having an arcuate photoconductive member, comprising:

a flat screen member for modulating an exposure source and spaced apart from the arcuate photoconductive member and fixed relative to the movement thereof, said flat screen member having ends and a longitudinal axis perpendicularly disposed to said ends;

a plurality of opaque lines disposed on said flat screen member, said plurality of arcuate opaque lines being centered along the longitudinal axis thereof; and at least one of said opaque lines being arcuate in shape.

12. The screen of claim 11 wherein all of said lines are arcuate in shape and disposed concavely with respect to the ends of said flat screen member along the longitudinal axis thereof.

13. The screen of claim 11 wherein each of said plurality of opaque lines includes a plurality of spaced apart opaque dots.

14. The screen of claim 11 wherein the arcuate shape of said at least one of said opaque lines is shaped such that the shadow of said at least one of said opaque lines on the arcuate photoconductive member is a substantially straight line.

15. The screen of claim 14 wherein all of said opaque lines are arcuate with the arc of all of said opaque lines incrementally decreasing from the distal ends of said flat screen member to the center thereof such that ones of said lines proximate to the center of said flat screen member are substantially straight.

16. The screen of claim 15 wherein each of said arcuate lines is concave in shape and centered along the longitudinal axis of said flat screen member and each of said opaque lines has at least two arcuate shapes, a centrally disposed arcuate shape and a second arcuate shape disposed on the distal ends of said opaque line.

17. The screen of claim 16 wherein each of said opaque lines comprises a separate segment associated with each of said arcuate shapes.

18. A method for blocking a portion of a light from a light source to an arcuate photoconductor member, comprising the steps of:

disposing a plurality of opaque lines in a plane spaced apart from the surface of the photoconductive member and fixed relative to the movement thereof for modulating an exposure source, each of the lines disposed centrally along the longitudinal axis of the photoconductive member and arranged substantially perpendicular thereto;

passing light from the light source through the opaque lines to the photoconductive member such that the opaque lines form a shadow on the arcuate photoconductive member; and at least one of the opaque lines having an arcuate shape.

19. The method of claim 18 wherein the step of disposing the plurality of opaque lines in a plane comprises disposing the plurality of opaque lines in a substantially flat plane that is parallel to a tangential plane on the surface of the arcuate photoconductive member and spaced apart therefrom.

20. The method of claim 19 wherein the at least one of the opaque lines having an arcuate shape is shaped such that when the light from the light source is passed through the at least one opaque line at an angle thereto a shadow is formed on the arcuate photoconductive member that is substantially a straight line.

21. The method of claim 19 wherein the step of passing light from the light source through the opaque lines comprises disposing the light above the plane of the opaque lines and substantially centered with respect thereto.

22. The method of claim 21 wherein each of the opaque lines is arcuate in shape extending from a point substantially beneath the light source and extending outward therefrom along the longitudinal axis of the arcuate photoconductive member with the arcuate shape of each of the opaque lines varying from the central point substantially beneath the light source to the last of the lines disposed outward from the central point.

23. The method of claim 22 wherein each of the opaque lines is shaped to provide a shadow on the arcuate photoconductive member that is substantially a straight line.

24. The method of claim 23 wherein each of the opaque lines includes at least a first central segment and two distal segments, the central segment having a first curvilinear shape and the two distal segments having a second curvilinear shape and the step of passing light from the light source through the opaque lines comprises disposing the light source at different distances from the opaque lines for different magnifications with the central portion of the opaque line providing a shadow that is a substantially straight line on the surface of the arcuate photoconductive member when the light source is more proximate to the opaque lines and the combination of the central portion and the two distal portions providing a shadow that is a substantially straight line for positions of the light source disposed farther out for higher magnifications.

* * * * *